United States Patent [19]

Bru

[11] 4,159,621

[45] Jul. 3, 1979

[54] FRICTION DISC FOR FALSE TWISTING

[75] Inventor: Christian Bru, Renaison, France

[73] Assignee: ASA S.A., Roanne, France

[21] Appl. No.: 908,674

[22] Filed: May 23, 1978

[30] Foreign Application Priority Data

May 25, 1977 [FR] France ..... 77 16634

[51] Int. Cl.[2] ..... D02G 1/04

[52] U.S. Cl. ..... 57/338; 57/337

[58] Field of Search ..... 57/77.4, 77.45, 332, 57/334, 337, 338, 339

[56] References Cited

U.S. PATENT DOCUMENTS

| | | | |
|---|---|---|---|
| 4,047,374 | 9/1977 | Venot | 57/77.4 X |
| 4,051,655 | 10/1977 | Lorenz et al. | 57/77.4 |

FOREIGN PATENT DOCUMENTS

| | | |
|---|---|---|
| 1202393 | 0000 | France. |
| 1255922 | 0000 | France. |
| 1261747 | 0000 | France. |

OTHER PUBLICATIONS

Premier Projet d'Avis Documentaire, Christian Bru, Nov. 1977.

*Primary Examiner*—Donald Watkins

*Attorney, Agent, or Firm*—Arnold, White & Durkee

[57] ABSTRACT

A friction disc for use in false twisting has a convex, yarn contacting, peripheral surface and a recess on one or both faces adjacent the periphery, there being a sharp edge between the peripheral surface and recess.

12 Claims, 5 Drawing Figures

FRICTION DISC FOR FALSE TWISTING

BACKGROUND OF THE INVENTION

1. Field of the Invention

The present invention relates to a friction disc for use in false twisting, and a false twisting spindle provided with such discs.

2. Description of the Prior Art

Texturising by false twisting is a technique which is in itself well known and is widely used, and which consists basically in continuously overtwisting a thermoplastics yarn, fixing the yarn when so deformed, in particular by the action of heat and of a subsequent cooling treatment, and finally untwisting the yarn by the amount to which it was twisted.

It has long been known to impart a false twist to a moving yarn by means of discs (see in particular U.S. Pat. No. 1,030,179 in the name of Hilden) and it has also been proposed to use this idea for false twist texturising, for which purpose friction discs are arranged spaced from one another to rotate on axles which are essentially parallel to one another, the discs overlapping each other (see especially French Pat. Nos. 1,202,393 and 1,255,922 in the name of Scragg and 1,261,747 in the name of Zavody).

The spindles most widely used at present for this purpose in general comprise three rotating axles supporting the discs, the axles being so arranged that as seen in plan view they are at the apices of an equilateral triangle. The discs overlap one another so that the yarn to be treated passes through the unit following a zig-zag path between the discs.

In general, each axle supports several superposed spaced apart discs, the discs of one axle being staggered relative to those of adjacent axles so that they overlap one another.

The friction discs generally have a simple shape, with a convex peripheral surface which the moving yarn contacts, and upper and lower surfaces which are generally planar.

Various materials have been used for producing such friction discs. Currently, the materials which give the best results and which are tending to replace the originally used polyurethanes are ceramic. Ceramics are generally insensitive to chemical agents, which is extremely valuable bearing in mind the number of chemicals used in sizings deposited on the yarns, and furthermore have high resistance to wear and high heat resistance which makes it possible to achieve high speeds, as well as very high hardness and freedom from fouling. Furthermore, the properties of ceramic are easily reproducible, which makes it possible to replace friction discs without altering the quality of the yarn, and which ensures that the quality is uniform from one position of the machine to another. Currently, the majority of friction discs are produced from solid ceramics, which has the advantage of very high reproducibility, though use of discs of which only the surfaces are coated with ceramic has been considered.

The three-axle spindles which are currently marketed essentially consist of a horizontal support on which are perpendicularly mounted the axles carrying their friction discs. These axles are connected to one another and are driven synchronously by a belt connected to a drive pulley.

The friction discs each possess a convex peripheral surface against which the yarn makes contact, and the discs partially overlap one another, with the spacing between two discs generally being of the order of 0.5 millimeter.

These devices are generally satisfactory, but it has been found that during continuous operation a slight deposit can form on the non-working surfaces of the discs, this usually arising from sizings of the yarns. Furthermore, the production of these discs requires rather high precision, in view of the fact that it is necessary that the yarn should, as far as possible, be in contact over an arc of the same length with each friction disc.

SUMMARY OF THE INVENTION

According to the present invention there is provided a friction disc for use in false twisting, the disc having a convex peripheral surface to be contacted by a yarn and the disc having, on one or both of its upper and lower surfaces, a recess, a sharp edge being defined at a position between the recess and the convex peripheral surface.

It has been found that such discs can be manufactured to larger tolerances while ensuring satisfactorily uniform contact with yarns, and that, surprisingly, they do not require such frequent cleaning compared to prior discs produced from the same material.

In a simple embodiment, the recess is cut into a small part of the thickness of the disc in the zone immediately adjacent to the convex peripheral surface, and the join of the outer side wall of the recess and this convex peripheral surface is the sharp edge. The outer side wall of the recess may be cylindrical.

In a variant, the recess has a concave curved surface of small radius of curvature intersecting the convex peripheral surface and forming the sharp edge therewith. The said concave curved surface may lead inwardly to a part conical surface leading to the external face of the disc.

The depth of the recess is generally small and is advantageously between 0.3 and 1 millimeter, a depth of 0.5 millimeter being suitable in the majority of cases.

Furthermore, the width of the recess, where the latter is of annular shape, is generally between 3 and 10 millimeters, a width of 4 to 5 millimeters generally being sufficient.

In addition, the sharp edge can be separated from the convex friction surface by a plane zone of small width, of the order of 0.05 millimeter to 1 millimeter, which, without affecting the functioning of the disc, makes it possible to enjoy larger manufacturing tolerances and hence to reduce the cost price.

Discs according to the invention are preferably ceramic, though discs of, for instance, metal or of any other suitable material can be used.

BRIEF DESCRIPTION OF THE DRAWINGS

In order that the invention may be more clearly understood, the following description is given, merely by way of example, with reference to the accompanying drawings in which.

DETAILED DESCRIPTION OF PREFERRED EMBODIMENTS

Figure 1:
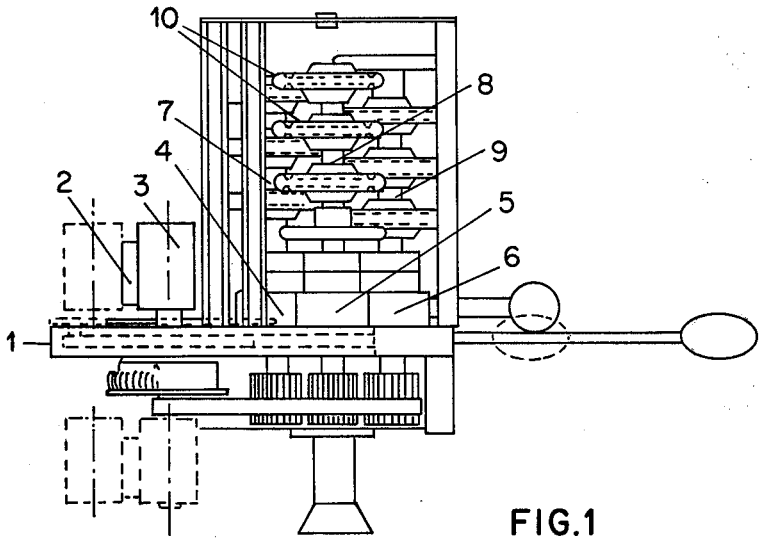
FIG. 1 is a side view of a frictional false twist spindle equipped with discs in accordance with the invention.

In the description which follows, like reference numerals are used to denote like parts.

As can be seen in FIG. 1, a false twist texturising spindle operates by passing a yarn over rotating parallel discs and essentially comprises a fixed base 1 adjacent which travels a tangential drive belt 2, a drive pulley 3 mounted on a shaft substantially at right angles to the base 1 and to be driven by the tangential belt 2, and three sockets 4, 5 and 6, also mounted on the base 1, parallel to the drive pulley 3, and respectively supporting three rotationally driven axles 7, 8 and 9, on which are mounted, at right angles, friction discs 10.

In conventional manner, the axles 7, 8 and 9 are located at the apices of a triangle, so that the friction discs mutually overlap so as to define a zig-zag path for the yarn.

As can be seen in FIGS. 2, 3, 4 and 5, the friction discs 10 each have a convex peripheral surface 11, with which the yarn 12, during its travel, is in contact, and an upper face 13 and a lower face 14 which are generally planar.

According to this invention, each disc possesses, on at least one and preferably both of its upper and lower faces 13, 14, a recess 16 of which the bottom is joined to the convex peripheral surface 11 by a surface which forms a sharp edge 15. Thus, in the embodiment illustrated in FIGS. 2 and 3, each recess 16 is of annular shape and has a bottom 20 joined to the convex peripheral surface 11 by a cylindrical surface 21, the intersection between the two surfaces 11 and 21 being a sharp edge 15.

Figure 4:
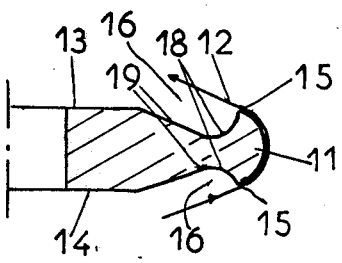
FIG. 4 is a partial sectional view showing another embodiment of disc according to the invention.

FIG. 4 illustrates another embodiment in which each recess 16 is of annular shape and consists of concave surface 18, of small radius of curvature, which intersects the convex peripheral surface 11 and forms, with the latter, a sharp edge 15. The concave surface 18 is extended inwards by a surface 19 of part conical shape, which leads to the external surfaces 13 and 14.

Figure 2:
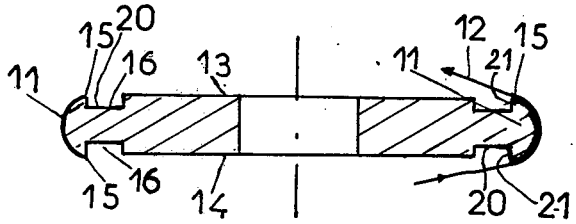
FIGS. 2 and 3 are respectively a cross-section and a top view of a disc according to the invention.
Figure 3:
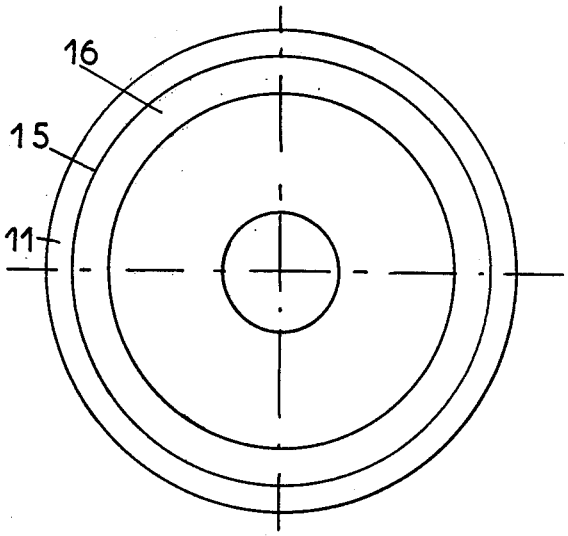
Figure 5:
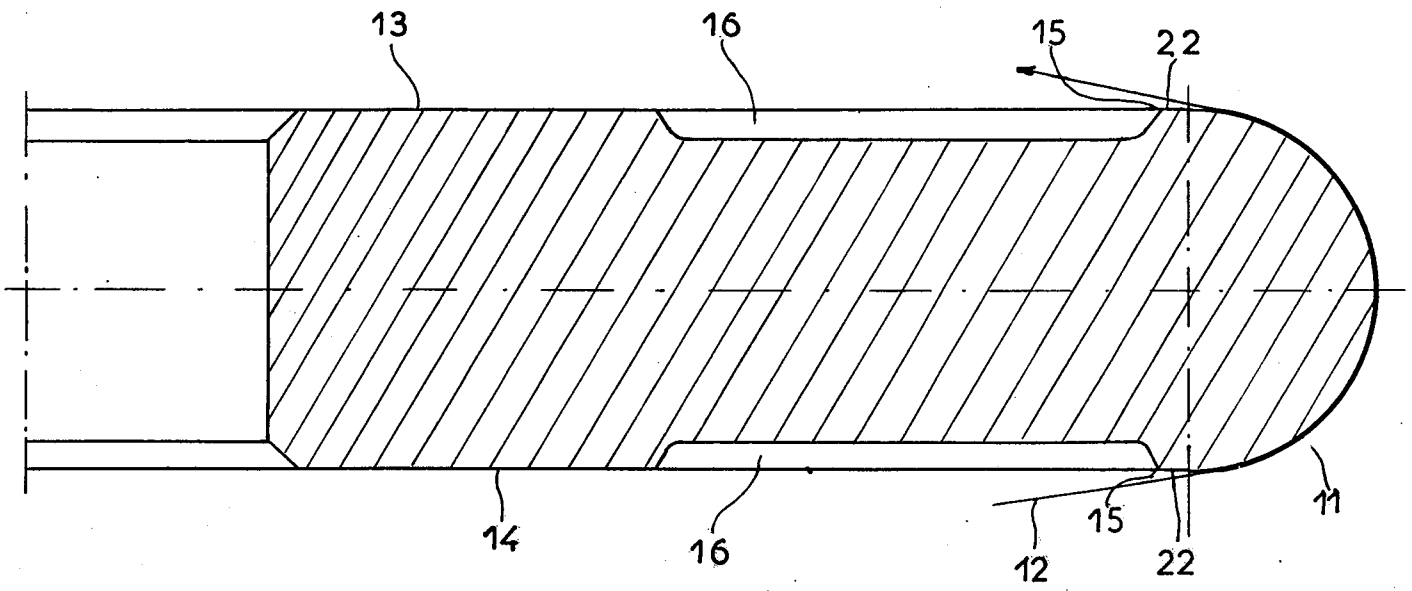
FIG. 5 illustrates, on a larger scale a modified disc of the type illustrated in FIGS. 2 and 3 in partial cross section.

FIG. 5 illustrates a modification of the discs of the type illustrated in FIGS. 2 and 3, in which the sharp edge 15 is separated from the convex friction surface 11 by a planar zone 21 of small width. Examples of discs according to the invention will now be described.

EXAMPLE 1

Friction discs as illustrated in FIGS. 2 and 3, and having the following characteristics, were produced:

material: ceramic-trademark Tital TS 14
thickness: 6 millimeters
external diameter: 45 millimeters
depth of the recess 16: 0.5 millimeter
width of the recess 16: 4 millimeters
distance of the edge 15 from the axle: 19.5 millimeters.

A false twist spindle as illustrated in FIG. 1 was constructed using such discs, the adjacent surfaces of the discs being spaced 0.5 millimeter apart and the distance between the axles being 33 millimeters.

EXAMPLE 2

Example 1 was repeated, but a plane surface 22 of about 0.2 millimeter was formed at the surfaces of the discs, after forming the recesses 16, as illustrated in FIG. 5.

This embodiment made it possible to obtain convex friction surfaces 11 which were very precise whilst increasing the manufacturing tolerances, and to do so without affecting the functioning of the spindle produced with the aid of such discs.

Compared to similar spindles using friction discs produced from the same material but not possessing a sharp edge in the vicinity of the convex friction surface, it was found that the required frequency of cleaning of the friction components was substantially reduced. Furthermore, the yarns obtained possessed identical properties from one position to another, due to the greater uniformity of friction from disc to disc.

I claim:

1. A friction disc for use in false twisting, such disc comprising a convex peripheral surface to be contacted by a yarn and upper and lower faces, a recess having a cylindrical outer side wall provided in at least one of said faces, and a sharp edge defined at a position between said recess and said convex peripheral surface.

2. A friction disc as claimed in claim 1 and further comprising an outer side wall to said recess, said sharp edge being formed where said outer side wall meets said peripheral surface.

3. A friction disc as claimed in claim 1 and further comprising an outer side wall to said recess, and an annular planar zone of small width between said recess and convex peripheral surface, said sharp edge being formed where said outer wall meets said planar zone.

4. A friction disc as claimed in claim 1 and further comprising a concave curved surface to said recess, said sharp edge being formed where said concave curved surface meet said peripheral surface.

5. A friction disc as claimed in claim 1 and further comprising a concave curved surface to said recess, and an annular planar zone of small width between said recess and convex peripheral surface, said sharp edge being formed where said concave curved surface meets said annular planar zone.

6. A friction disc as claimed in claim 4 including a part conical surface to said recess by which said concave curved surface is connected to said face of said disc.

7. A friction disc as claimed in claim 5 including a part conical surface to said recess by which said concave curved surface is connected to said face of said disc.

8. A friction disc as claimed in claim 1 wherein the depth of the recess is from 0.3 to 1.0 millimeters and its width is from 3 to 10 millimeters.

9. A friction disc as claimed in claim 1 which is of ceramic material.

10. A false twisting spindle having at least two axles, there being, on each axle, at least one friction disc, the friction discs overlapping and at least some of the discs comprising a convex peripheral surface to be contacted by a yarn and upper and lower faces, a recess having a cylindrical outer side wall provided in at least one of said faces, and a sharp edge defined at a position between said recess and said convex peripheral surface.

11. A friction disc for use in false twisting, such disc comprising a convex peripheral surface to be contacted by a yarn and upper and lower faces, a recess having a concave curved surface provided in at least one of said faces, and a sharp edge being formed where said concave curved surface meets said peripheral surface.

12. A friction disc for use in false twisting, such disc comprising a convex peripheral surface to be contacted by a yarn and upper and lower faces, a recess having a concave curved surface provided in at least one of said faces, an annular planar zone of small width between said recess and said convex peripheral surface, and a sharp edge formed where said concave surface meets said annular planar zone.

* * * * *